US005177446A

United States Patent [19]

Boriani et al.

[11] Patent Number: 5,177,446

[45] Date of Patent: Jan. 5, 1993

[54] DEVICE FOR MONITORING THE DEPLETION OF MATERIAL UNCOILING FROM ROLLS, APPLICABLE IN PARTICULAR TO WRAPPING MACHINES

[75] Inventors: Silvano Boriani; Antonio Gamberini, both of Bologna, Italy

[73] Assignee: G.D. Societa Per Azioni, Bologna, Italy

[21] Appl. No.: 547,182

[22] Filed: Jul. 3, 1990

[30] Foreign Application Priority Data

Jul. 5, 1989 [IT] Italy ..... 3541 A/89

[51] Int. Cl.[5] ..... B65H 18/00; G08B 21/00; G01R 27/26

[52] U.S. Cl. ..... 324/671; 242/57; 340/675

[58] Field of Search ..... 242/57; 340/675; 324/671, 660, 661-663

[56] References Cited

U.S. PATENT DOCUMENTS

| | | | |
|---|---|---|---|
| 3,227,951 | 1/1966 | Dykaar | 324/671 |
| 3,409,242 | 11/1968 | Kishioka | 242/57 |
| 3,662,576 | 5/1972 | Girlatschek | 72/21 |
| 4,170,346 | 10/1979 | Murray et al. | 340/675 |
| 4,620,184 | 10/1986 | Nedstedt | 340/675 |
| 4,682,105 | 7/1987 | Thorn | 324/230 |
| 4,913,366 | 4/1990 | Andou | 242/57 |
| 4,913,367 | 4/1990 | Hata | 242/57 |

FOREIGN PATENT DOCUMENTS

| | | | |
|---|---|---|---|
| 155020 | 9/1985 | European Pat. Off. . | |
| 2104876 | 3/1983 | United Kingdom | 242/57 |
| 2205951 | 12/1988 | United Kingdom . | |

*Primary Examiner*—Jack B. Harvey
*Assistant Examiner*—Maura K. Regan
*Attorney, Agent, or Firm*—Cushman, Darby & Cushman

[57] ABSTRACT

A sensing facility that is integrated into a station from which strip material is fed to a wrap station, and/or into the roll and shaft from which the strip is effectively uncoiled, is designed to monitor an electrical impedance generated by the roll and shaft and/or linked to their overall radial dimensions. An output signal is triggered when the monitored level of impedance matches a selected reference value.

8 Claims, 3 Drawing Sheets

DEVICE FOR MONITORING THE DEPLETION OF MATERIAL UNCOILING FROM ROLLS, APPLICABLE IN PARTICULAR TO WRAPPING MACHINES

BACKGROUND OF THE INVENTION

The present invention relates to a device for monitoring the depletion of bulk paper rolls, in particular as applicable to wrapping machines. Conventionally, the wrapping papers and/or sheer thermoplastic film materials utilized for packaging commodities by machine, and in particular by the machines which wrap cigarretts, are supplied wound in rolls or onto spools often of considerable dimensions.

In order to avoid stoppages occasioned by the roll of film or paper running out, these machines are usually provided with a work station incorporating two parallel pivots, each coaxially and rotatably supporting a relative roll; while one of the rolls is uncoiled and the continuous strip material fed to a cutting device for separation into discrete lengths as required by the wrapper assemblies of the machine, the other provides a reserve supply, ready to be connected up to the wrapping line the moment that the current roll is exhausted.

The depletion of the strip is monitored, and the empty roll ultimately replaced, by a conventional device including an arm positioned above the roll itself and pivoted at one end to a release mechanism. The remaining end of the arm carries an idle wheel or roller riding in contact with the outer circumference of the roll, generally under its own weight.

The device thus remains continuously in contact with the rolled strip material, and the gradual reduction in bulk of the roll causes the arm to drop until reaching a given angle in relation to its starting position, which corresponds to a given minimum radius from the center of rotation of the roll (calculated and set by the operator according to the size of bulk roll utilized). At this point, the arm activates the release mechanism, e.g. by means of a switch associated with its pivoted end, and sets the changeover operation in motion.

A device featuring improvements on the above described basic design is disclosed in EP 155 020. As disclosed in that document, the roll is fitted at center with an element generating a magnetic field, and use is made of an arm similar to that aforementioned but carrying a magnetic sensor at the end offered to the strip. The sensor is connected directly to the release mechanism, which must intervene to prevent further rotation of the empty roll, and set to respond when exposed to a predetermined magnetic field value substantially reflecting the approach of the middle of the roll, by relaying a signal to the mechanism. Both the devices above mentioned have drawbacks, from engineering and economic standpoints alike.

In particular, the first device (basically a mechanical system) is notably imprecise in sensing the end of the strip uncoiling from the roll. More exactly, the sensing operation can be rendered false both by possible imperfections in the shape of the roll (which may ovalize either as a result of being dropped, or more especially, as a result of being wound onto a core or center less than perfectly cylindrical in shape), and by the fact that monitoring is indirect and effected through intermediate mechanical media.

Under these conditions, the prescribed release and changeover angle may be reached accidentally early by the arm, resulting in a waste of strip material that could in fact have been utilized.

The second device partly overcomes the drawbacks just mentioned, but is conditioned economically by the fact that each roll has to be fitted with a source from which to generate the magnetic field. What is more, the value of the magnetic field itself can be influenced by external factors; in the event of the field being enlarged, the reading returned by the sensor will be false, and the roll once again taken out of operation with an excessive amount of strip jettisoned as waste instead of being used.

SUMMARY OF THE INVENTION

Accordingly, the object of the present invention is to eliminate the drawbacks aforementioned through the embodiment of a device capable of monitoring a quantity of wound strip material in direct manner, which is accurate in its assessment of the amount of strip remaining on a depleting roll, as well as being cost-effective.

The stated object is realized in a device according to the invention, for monitoring the depletion of material uncoiling from bulk rolls as utilized with wrapping machines.

Such a device is applicable to machines having a feed station equipped with at least one roll-and-roll-shaft assembly rotatable about its own axis and supplying a wrap station with a continuous strip of material uncoiled from the roll-and-roll-shaft assembly.

The device disclosed includes means, located at the feed station and/or at the roll-and-roll-shaft assembly, designed to sense an electrical impedance generated from the roll-and-roll-shaft assembly, or a function of its radial dimensions (or both) and to relay a signal on encountering a value of impedance equal to a preset reference value.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
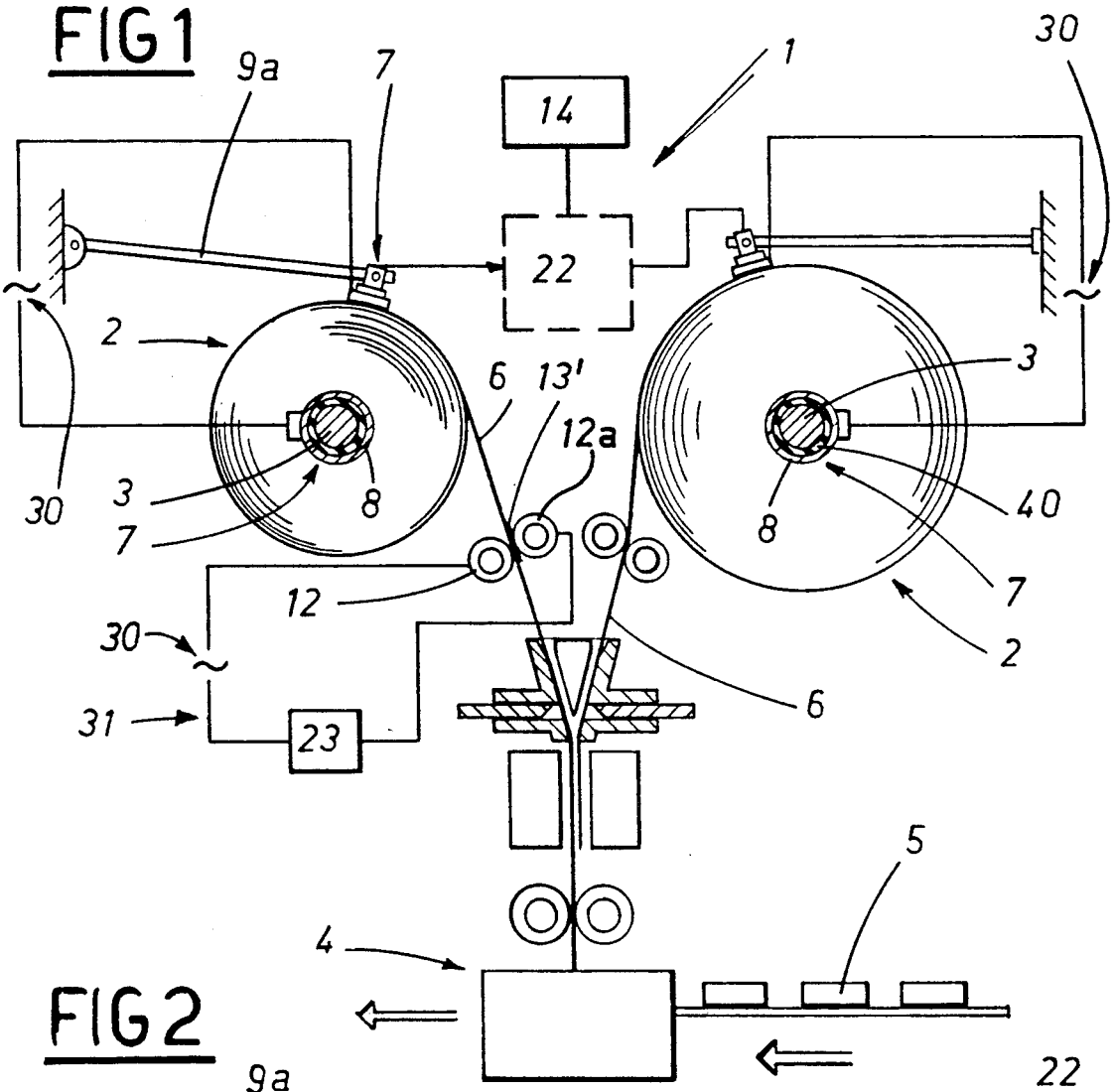
FIG. 1 is the schematic frontal elevation of a strip material feed station equipped with a device embodied according to the present invention.

With reference to the drawings, the device to which the invention relates is utilized in conjunction with wrapping machines of the type incorporating a feed station, denoted 1 in its entirety, from which a strip of material 6 is supplied to a station 4 where commodities 5 such as boxes or packets are enveloped or wrapped. In the example illustrated, the feed station 1 is equipped with two assemblies comprising a supply roll 2 and a supporting shaft 3 (one roll operational and one in reserve at any given moment), each rotatable about its own axis and supplying strip 6 to the wrapping station 4. Numeral 7 denotes means, operating at the feed station 1, by which to sense an intrinsic impedance relative to the roll-and-roll-shaft assembly 2-3.

Such an impedance can be generated directly from the roll 2 and roll shaft 3, as in the examples shortly to be described, and as such will be a function of the radial dimension R of the assembly.

The sensing means 7 are designed to generate a signal on encountering an impedance equal to a selected reference value.

Figure 2:
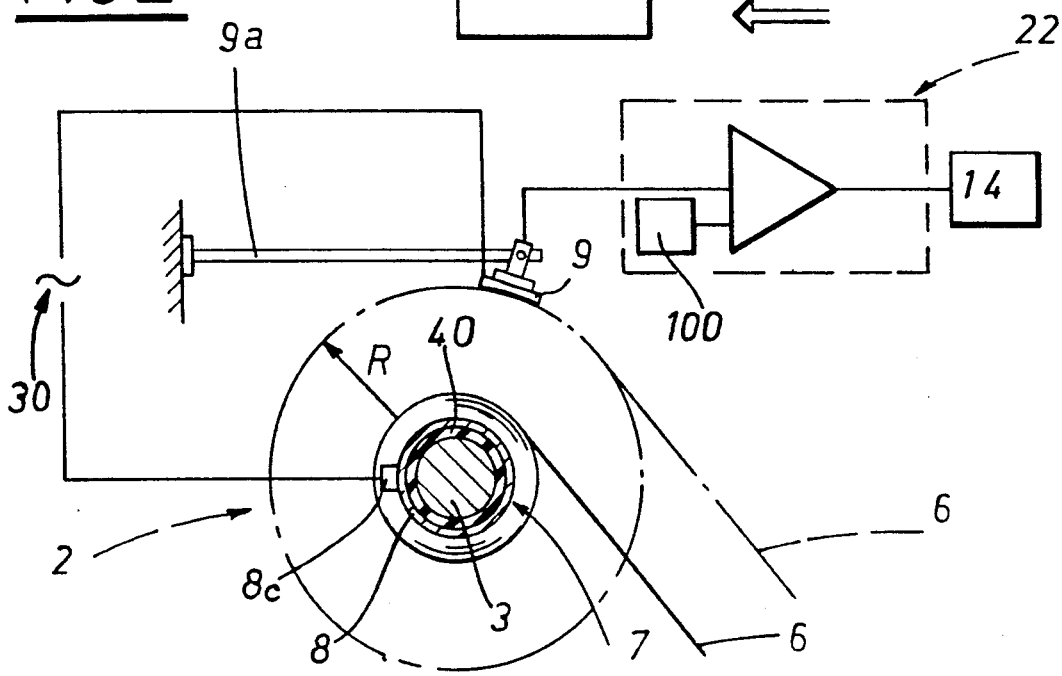
FIG. 2 is the schematic frontal elevation of a roll-and-roll-shaft assembly equipped with a device embodied according to the present invention.

More in detail, such sensing means 7 include a cylindrical element or core 8 (FIG. 2) interposed coaxially between the roll 2 and the roll shaft 3, and a shoe or plate 9 occupying a fixed radial position relative to the core 8 and carried by an arm 9*a* fastened to the feed station 1; the core 8 is separated from the roll shaft 3 by a cylindrical insulator 40. The plate 9 will, of course, be set at a distance from the core 8 no less than the maximum envisaged radial depth of the assembled roll 2 and roll shaft 3, in order to permit of mounting the roll 2 to the shaft 3.

Numeral 30 denotes an electrical power source to which the cylindrical core 8 and the plate 9 are connected by way of sliding contacts 8*c* and in direct fashion, respectively; thus, each element constitutes one armature of a capacitor in which the dielectric medium is the continuous strip material 6 wound onto the roll 2.

Sensing means embodied in this manner are designed to respond to the capacitive reactance component of impedance, which is a function of the thickness of the strip 6, the dielectric constant (permittivity) of the strip material being par; as the roll 2 uncoils, in effect, a portion of the dielectric is replaced gradually by air, of which the dielectric constant is different from that of the strip 6, and accordingly, electronic means will be incorporated the purpose of which is to compensate automatically and in real time for the variation in permittivity while the value of capacitive reactance at which the sensing means 7 are required to generate their signal remains unaffected.

The capacitor stage is connected to measurement and comparison means 22; on receipt of an impedance value from the capacitor equal to the previously selected reference value, which is generated by an adjustable circuit 100 and reflects a prescribed minimum radial depth of the roll 2, these means 22 will relay an output signal to control means 14 that trigger replacement of the empty roll 2 with a full roll by conventional means.

Figure 3:
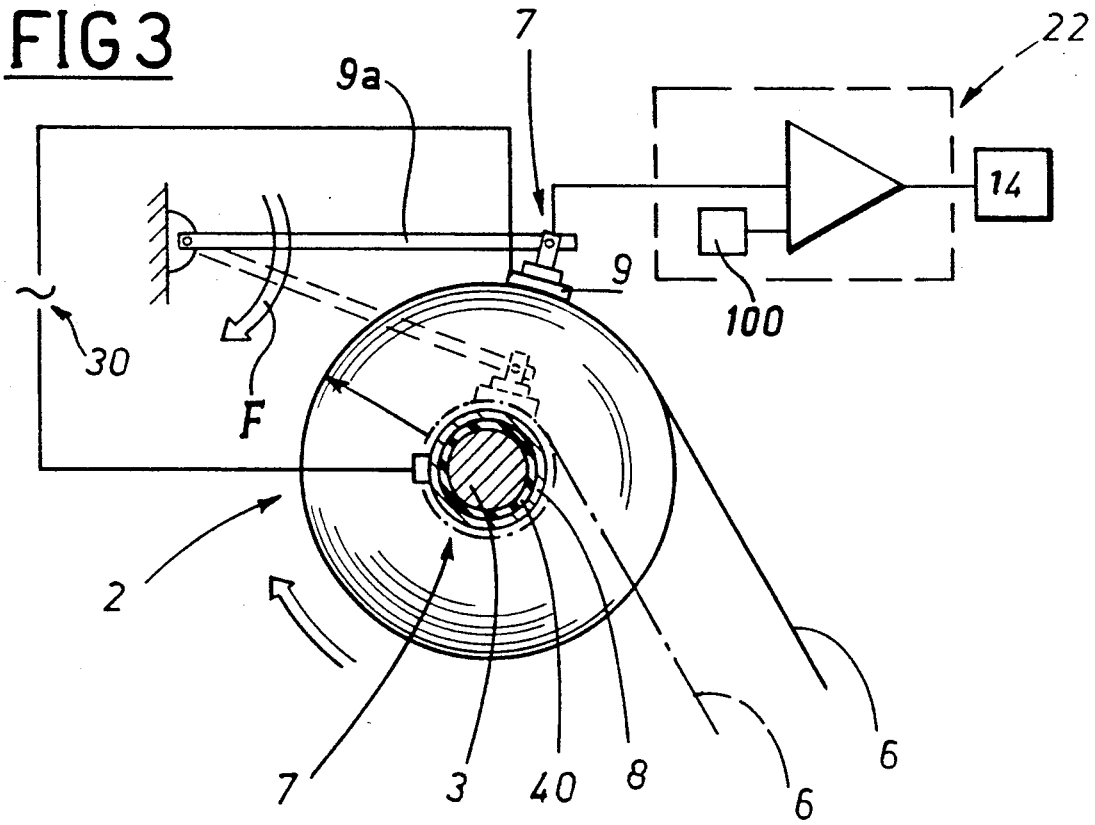
FIG. 3 is a schematic frontal elevation of the roll-and-roll-shaft assembly of FIG. 2.

FIG. 3 illustrates an alternative embodiment of the sensing means 7, in which the plate 9 is rendered capable of radial movement relative to the roll 2 by mounting its supporting arm 9*c* pivotably to the feed station 1 at one end. In this instance, the plate 9 rotates toward the cylindrical core 8 (see arrow F) as the strip 6 uncoils from the roll 2. Again, the plate 9 and the core 8 are connected to an electrical power source 30 and constitute the armatures of the capacitor stage; on arrival at a value of impedance equal to the reference value, the measure-and-compare means 22 relay a signal to the control means 14 and the roll 2 is stopped and changed.

Figure 4:
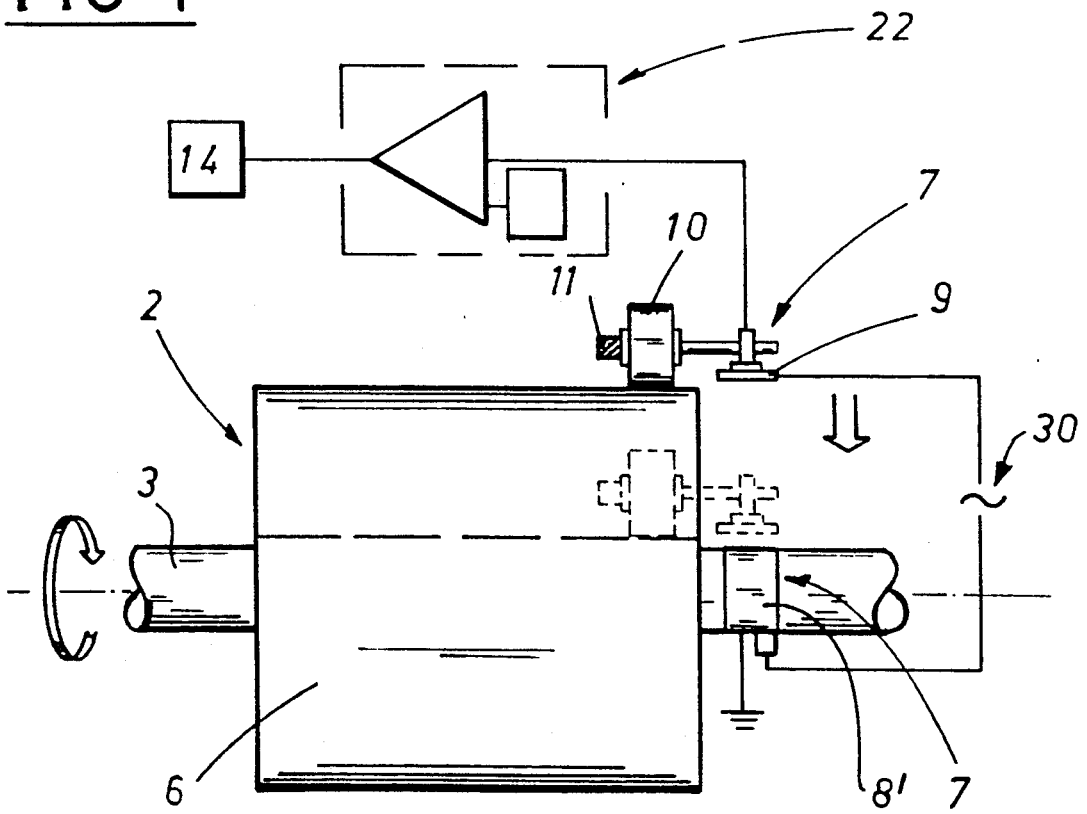
FIGS. 4 and 5 are schematic side elevations of the roll-and-roll-shaft assembly of FIG. 3, showing two alternative embodiments of the device according to the present invention.

In FIG. 4, the plate 9 of the sensing means 7 is carried externally of the dimensional compass of the roll 2 by a freely revolving roller 10 riding in permanent contact with the circumferential surface of the roll 2 and mounted to an arm 11 hinged at one end to the feed station 1. In this type of embodiment, the plate 9 is directed toward a cylindrical metal element 8' fixed coaxially to the roll shaft 3.

Connected to a power source 30 as in FIG. 3, the armature elements 8' and 9 of the sensing means 7 in this arrangement form part of a capacitor in which air provides the dielectric medium; thus, as the plate 9 approaches the metal element 8' and the intervening layer of air reaches a minimum at which capacitive reactance equals the reference value, the measure-and-compare means 22 relay a signal to the control means 14, the roll 2 is stopped, and a changeover is effected.

Figure 5:
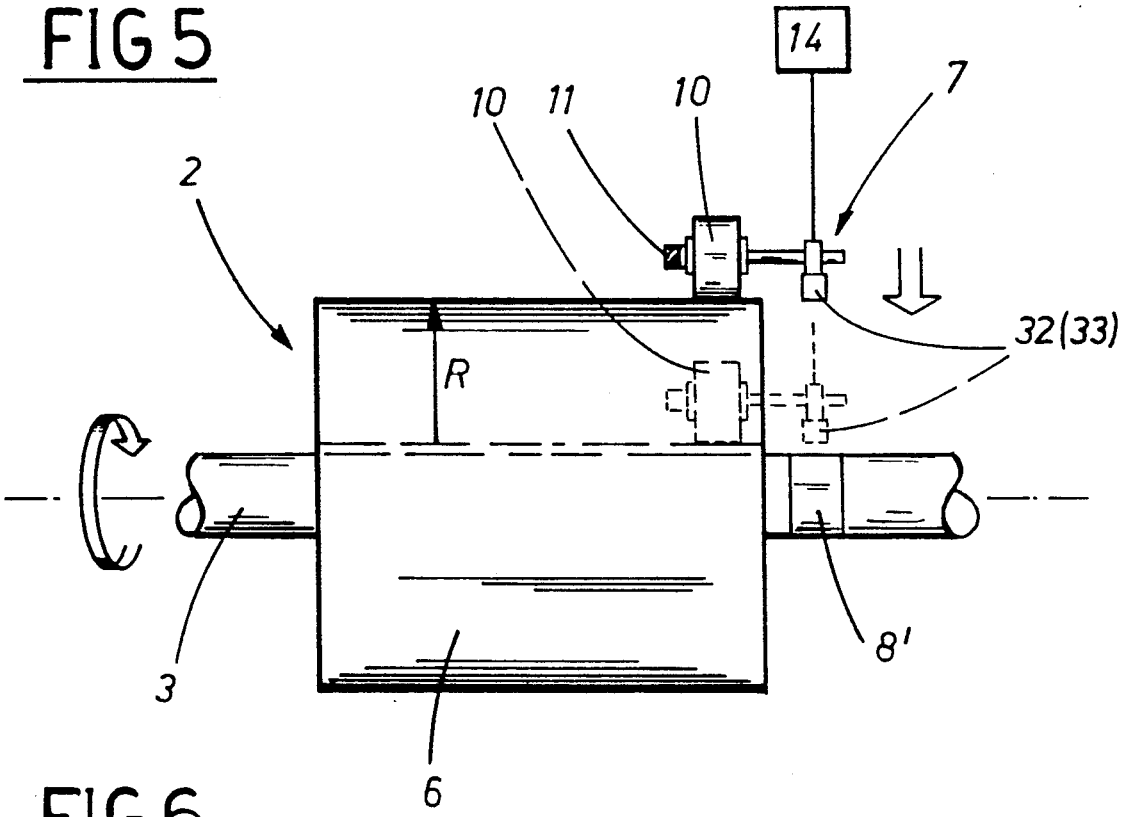
Figure 6:
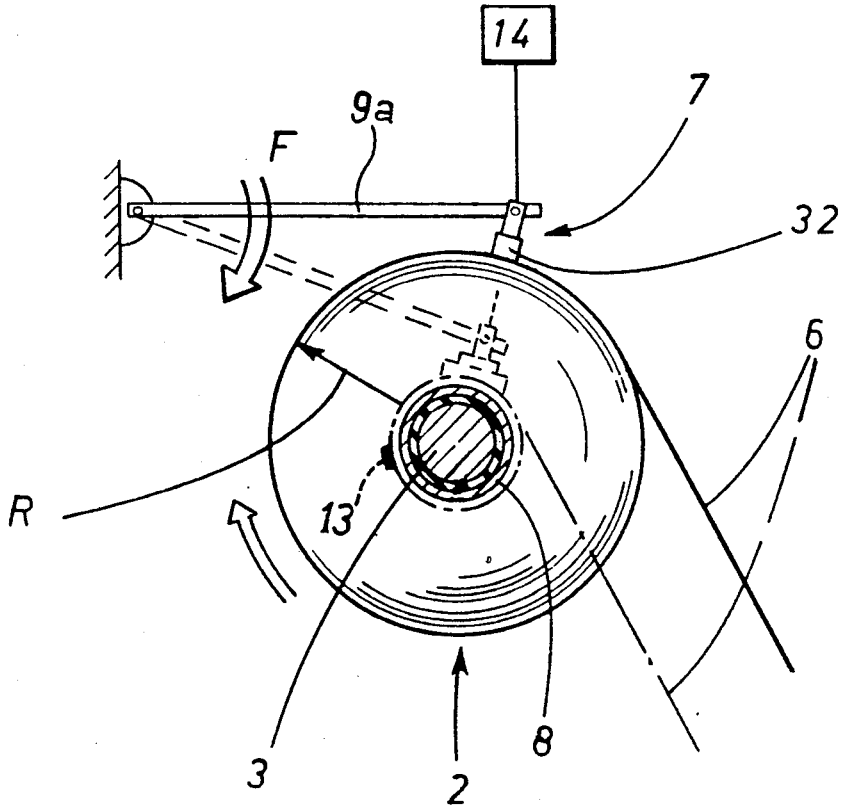
FIG. 6 is a frontal elevation showing a further alternative embodiment of the device illustrated in FIG. 3.

In the embodiments of FIGS. 5 and 6, sensing means 7 consist in an inductive or a capacitive proximity transducer, denoted 32 and 33, respectively. The inductive transducer 32 is mounted using either the pivoted arm 9*a* of FIG. 3 (as in FIG. 6), or the roller 10 and arm 11 of FIG. 4 (as in FIG. 5), and thus can be positioned either externally of the axial compass of the roll 2 (FIG. 5), or internally (FIG. 6). For inductive operation, the transducer 32 requires a metal element capable of varying and damping the magnetic field generated in such a way as to produce an output signal for transmission direct to the control means 14.

As discernible in FIGS. 5 and 6, use might be made of a cylindrical metal element 8' or core 8 keyed coaxially to the roll shaft 3 in the manner already described, or of an element associated with the core 8 (in the event that the core is not metallic) or again, by way of example, of a band of metal 13 applied direct to the strip 6 and running across one of the final turns nearest the center of the roll 2. To reiterate, the transducer might be capacitive rather than inductive.

In the arrangement of FIG. 5, for example, where the capacitive transducer 33 is carried by a freely revolving roller 10 mounted to an arm 11 pivotably anchored at one end to the feed station 1, the transduction principle is to sense the existence of a dielectric constant other than that of the medium in which movement and operation occurs; in the case in point, the transducer 33 senses a variation in dielectric constant of the air when approaching a different medium (e.g. the cylindrical element 8') and causes a signal to be relayed to the changeover control means 14.

In a further alternative embodiment of the device, illustrated in FIG. 1, the sensing means 7 include a pair of rollers 12 and 12*a*, both connected to an electrical power source 30 by way of a circuit denoted 31; these might also be the pinch rollers by which the strip 6 is fed to the wrap station, and accordingly, will be positioned in permanent contact with the strip 6, one on either side. The voltage or potential difference at the rollers 12 and 12*a* must be less than the dielectric strength of the material from which the strip 6 is fashioned (dielectric strength being the maximum electric field sustainable by an insulator, in this case the strip 6, before disruption occurs).

Numeral 13' denotes a band or leaf of metal applied to one of the final turns of the uncoiling strip 6. At the moment in which the band 13' enters into contact with the rollers 12 and 12*a*, a short circuit occurs and current can flow from one roller to the other; this is sensed by a differential 23 wired into the relative circuit 31, and a corresponding output signal is relayed to the control means 14.

What is claimed is:

1. A device for monitoring depletion of a continuous strip of material uncoiling from a roll of a wrapping machine, comprising:

a feed station having at least one roll-and-roll-shaft assembly rotatable about the longitudinal axis of the roll and roll shaft thereof, for uncoiling a continuous strip of material coiled on the roll thereof;

a wrap station, arranged to be supplied with said continuous strip of material as said strip is uncoiled from said roll of said roll-and-roll-shaft assembly of said feed station;

sensing means, located at one of said feed station and said roll-and-roll-shaft assembly for sensing an electrical impedance that is generated by at least one of:

said roll of said roll-and-roll-shaft assemblies, and a function of location of an imaginary cylindrical shell of known radius located between opposite ends of said roll shaft and coaxial with said axis, and for relaying an output signal upon encountering a value of impedance which is at least as great as a preset reference value;

said sensing means including:

a cylindrical element located between and coaxial with said roll and said roll shaft;

a shoe or plate occupying a fixed radial position in relation to said cylindrical element, said cylindrical element and said shoe or plate being separated by a distance that is sufficiently great as to permit mounting a full said roll when bearing a predetermined full amount of said continuous strip of material coiled thereon, on said shaft;

an electrical power source, to which said shoe or plate and said cylindrical element are both operatively connected in such a way as to constitute respective armatures of a capacitor stage in which the dielectric is provided by said strip of material coiled on said roll, and of which the capacitive reactance is a function of the thickness of the material of said strip occupying the space between said cylindrical element and said shoe or plate, permittivity of said material being par; and measurement and comparison means, operatively connected to said capacitor stage for generating an output signal upon sensing an impedance which is at least as great as a selected reference value.

2. A device for monitoring depletion of a continuous strip of material uncoiling from a roll of a wrapping machine, comprising:

a feed station having at least one roll-and-roll-shaft assembly rotatable about the longitudinal axis of the roll and roll shaft thereof, for uncoiling a continuous strip of material coiled on the roll thereof;

a wrap station, arranged to be supplied with said continuous strip of material as said strip is uncoiled from said roll of said roll-and-roll-shaft assembly of said feed station;

sensing means, located at one of said feed station and said roll-and-roll-shaft assembly for sensing an electrical impedance that is generated by at least one of:

said roll of said roll-and-roll-shaft assemblies, and a function of location of an imaginary cylindrical shell of known radius located between opposite ends of said roll shaft and coaxial with said axis, and for relaying an output signal upon encountering a value of impedance which is at least as great as a preset reference value;

said sensing mans including:

a cylindrical element which is located radially between and disposed coaxial with said roll and said roll shaft;

a shoe or plate carried by an arm pivotably anchored at one end to said feed station and riding in permanent radial contact with the strip coiled onto said roll;

an electrical power source, to which said shoe or plate and said cylindrical element are both operatively connected in such a way as to constitute respective armatures of a capacitor stage in which the dielectric medium is provided by said strip of material coiled on said roll, and of which the capacitive reactance is a function of the thickness of the material of said strip occupying the space between said cylindrical element and said shoe or plate, permittivity of said material being par;

measurement and comparison means, operatively connected to said capacitor stage for generating an output signal upon sensing an impedance which is at least as great as a selected reference value.

3. A device for monitoring depletion of a continuous strip of material uncoiling from a roll of a wrapping machine, comprising:

a feed station having at least one roll-and-roll-shaft assembly rotatable about the longitudinal axis of the roll and roll shaft thereof, for uncoiling a continuous strip of material coiled on the roll thereof;

a wrap station, arranged to be supplied with said continuous strip of material as said strip is uncoiled from said roll of said roll-and-roll-shaft assembly of said feed station;

sensing means, located at one of said feed station and said roll-and-roll-shaft assembly for sensing an electrical impedance that is generated by at least one of:

said roll of said roll-and-roll-shaft assemblies, and a function of location of an imaginary cylindrical shell of known radius located between opposite ends of said roll shaft and coaxial with said axis, and for relaying an output signal upon encountering a value of impedance which is at least as great as a preset reference value;

said sensing means including:

a cylindrical element secured coaxially to said roll shaft beyond the axial extent of said roll;

a shoe or plate occupying a same diametral plane, relative to said axis, as said cylindrical element and carried by a freely revolving roller mounted to an arm pivotably anchored at one end to said feed station and riding in permanent circumferential contact with said strip of material coiled onto said roll;

an electrical power source, to which said shoe or plate and said cylindrical element are both operatively connected in such a way as to constitute respective armatures of a capacitor stage in which the dielectric medium is air, and of which the capacitive reactance is a function of the distance separating said cylindrical element and said shoe or plate;

measurement and comparison means, operatively connected to said capacitor stage for generating an output signal upon sensing an impedance which is at least as great as a selected reference value.

4. A device for monitoring depletion of a continuous strip of material uncoiling from a roll of a wrapping machine, comprising:

a feed station having at least one roll-and-roll-shaft assembly rotatable about the longitudinal axis of the roll and roll shaft thereof, for uncoiling a continuous strip of material coiled on the roll thereof;

a wrap station, arranged to be supplied with said continuous strip of material as said strip is uncoiled from said roll of said roll-and-roll-shaft assembly of said feed station;

sensing means, located at one of said feed station and said roll-and-roll-shaft assembly for sensing an electrical impedance that is generated by at least one of:

said roll of said roll-and-roll-shaft assemblies, and a function of location of an imaginary cylindrical shell of known radius located between opposite ends of said roll shaft and coaxial with said axis, and for relaying an output signal upon encountering a value of impedance which is at least as great as a preset reference value;

said sensing means including:

a pair of rollers disposed for permanent contact with, respective opposite faces of said strip of material adjacent where said strip of material uncoils from said roll, said rollers being operatively connected to an electrical power source by a relative circuit and being thereby provided with a potential difference which is less than the dielectric strength of the material from which said strip of material is made;

an electrically conductive band of material arranged for application to said strip of material during manufacture of said strip of material, at a point coinciding with a radially inner coiled turns of said strip of material on the roll, said band having dimensions such as to interconnect and short-circuit said rollers in said relative circuit;

measurement and comparison means incorporated into said relative circuit connecting the rollers with said power source, for generating an output signal upon sensing the passage of current of at least a given amount through said relative circuit.

5. A device for monitoring depletion of a continuous strip of material uncoiling from a roll of a wrapping machine, comprising:

a feed station having at least one roll-and-roll-shaft assembly rotatable about the longitudinal axis of the roll and roll shaft thereof, for uncoiling a continuous strip of material coiled on the roll thereof;

a wrap station, arranged to be supplied with said continuous strip of material as said strip is uncoiled from said roll of said roll-and-roll-shaft assembly of said feed station;

sensing means, located at one of said feed station and said roll-and-roll-shaft assembly for sensing an electrical impedance that is generated by at least one of:

said roll of said roll-and-roll-shaft assemblies, and a function of location of an imaginary cylindrical shell of known radius located between opposite ends of said roll shaft and coaxial with said axis, and for relaying an output signal upon encountering a value of impedance which is at least as great as a preset reference value;

said sensing means including:

an inductive proximity transducer carried by an arm pivotably anchored to said feed station and disposed substantially in contact with said strip of material wound onto said roll, and for generating a signal when a magnetic field of said transducer is damped by the proximity of a metal element applied to the strip at a point coinciding with a radially inner coiled turn of said strip of material on said roll.

6. A device for monitoring depletion of a continuous strip of material uncoiling from a roll of a wrapping machine, comprising:

a feed station having at least one roll-and-roll-shaft assembly rotatable about the longitudinal axis of the roll and roll shaft thereof, for uncoiling a continuous strip of material coiled on the roll thereof;

a wrap station, arranged to be supplied with said continuous strip of material as said strip is uncoiled from said roll of said roll-and-roll-shaft assembly of said feed station;

sensing means, located at one of said feed station and said roll-and-roll-shaft assembly for sensing an electrical impedance that is generated by at least one of:

said roll of said roll-and-roll-shaft assemblies, and a function of location of an imaginary cylindrical shell of known radius located between opposite ends of said roll shaft and coaxial with said axis, and for relaying an output signal upon encountering a value of impedance which is at least as great as a preset reference value;

said sensing means including:

an inductive proximity transducer carried by an arm pivotably anchored to said feed station for generating a signal when a magnetic field of said transducer is damped by the proximity of a cylindrical metal element associated with said roll shaft.

7. A device as defined in claim 5, wherein:

said inductive proximity sensor is carried by a freely revolving roller mounted to said pivotally anchored arm and riding in permanent circumferential contact with said strip of material coiled onto said roll.

8. A device as defined in claim 6, wherein:

said inductive proximity sensor is carried by a freely revolving roller mounted to said pivotally anchored arm and riding in permanent circumferential contact with said strip of material coiled onto said roll.

* * * * *